US005404096A

United States Patent [19]

Thiel

[11] Patent Number: 5,404,096

[45] Date of Patent: Apr. 4, 1995

[54] SWITCHABLE, UNINTERRUPTIBLE REFERENCE GENERATOR WITH LOW BIAS CURRENT

[75] Inventor: Frank L. Thiel, Richardson, Tex.

[73] Assignee: Texas Instruments Incorporated, Dallas, Tex.

[21] Appl. No.: 79,312

[22] Filed: Jun. 17, 1993

[51] Int. Cl.[6] ..... G05F 3/16

[52] U.S. Cl. ..... 323/312; 323/315

[58] Field of Search ..... 323/312, 313, 314, 315, 323/316; 307/296.1, 296.6, 296.7

[56] References Cited

U.S. PATENT DOCUMENTS

| | | | |
|---|---|---|---|
| 4,682,098 | 7/1987 | Seevinck et al. | 323/315 |
| 4,808,908 | 2/1989 | Lewis et al. | 323/313 |
| 4,958,122 | 9/1990 | Main | 323/315 |
| 4,990,864 | 2/1991 | Kwan | 330/288 |
| 5,015,942 | 5/1991 | Kolanko | 323/315 |
| 5,015,942 | 5/1991 | Kolanko | 323/315 |

*Primary Examiner*—Steven L. Stephan
*Assistant Examiner*—Adolf Berhane
*Attorney, Agent, or Firm*—Christopher L. Maginniss; W. James Brady III; Richard L. Donaldson

[57] ABSTRACT

A switchable, uninterruptible, low-current reference generator with zero off-state current includes a cross-coupled, cascodeal $\Delta V_{be}$ current reference (70,72,74,76,78) for providing an output current, a current mirror (66,68) coupled in a cascode configuration with the current reference, and a start-up circuit (12) responsive to the absence of the output current for generating a start-up current ($I_{58}$) to the current mirror. Start-up current is disabled when output current is restored, and the current mirror bootstraps the output current into regulation. Standby logic (10), comprising FET's configured as CMOS inverters, provides a TTL-compatible, active-low input, and switching FET's (60,80,90,92,94) responsive to the standby logic ensure that the reference generator draws no current in its off state. When the reference generator is turned on, a hysteresis circuit (98,52) coupled to the standby logic (10) increases the input voltage required for turn-off. The disclosed reference generator provides a bias current with a very low temperature coefficient and very little supply dependence. It has an active-low logic implementation with switching near the TTL range. It uses very little overhead current, and it cannot be forced permanently out of regulation by system transients. Because the start-up scheme uses actual detection of the absence of a bias current as its trigger, the reference generator will restart without the need for power supply ramping in the event of loss of bias during operation.

20 Claims, 2 Drawing Sheets

SWITCHABLE, UNINTERRUPTIBLE REFERENCE GENERATOR WITH LOW BIAS CURRENT

BACKGROUND OF THE INVENTION

The present invention relates generally to electronic circuits and, more particularly, to an integrated circuit, low current reference generator.

Modern integrated circuits are often required to operate with very small values of supply current. When this value is in the microampere range, developing a practical integrated solution is a particular challenge due to the inherently large size and/or inaccuracy of any device that must withstand a large amount of supply voltage without passing significant amounts of current. For example, for a resistor to be required to limit a 10 volt supply to a 2 microampere ($\mu$A) bias current, would necessitate a 5 Mfi resistance, a value which is impractical in the realm of most of today's integrated circuits.

In addition, it is often desired to be able to switch the circuit off and have the entire integrated circuit (IC) appear to the system as if it were an open circuit. For the convenience of the external implementation in a particular application envisioned for the present invention, it is desired to have this enabling function operate in the transistor-transistor logic (TTL) threshold specification, and enable the circuit to its powered-on condition when the voltage level of an interface signal is below the lower TTL threshold, i.e., 0.8 volts, referred to as active-low logic. This requires a switchable input that will use no current when it is off.

One solution to the low current reference is to use a bootstrapped current mirror, where the generated current is reflected back to the input to serve as a load. This can accurately provide very low levels of current. However, such schemes are plagued by start-up problems; they require some technique to get current flow started. A typical approach may be to use a capacitor attached to ground. Thus, when the supply turns on, the capacitor injects the stored charge into the current mirror and current flow is initiated, with the bootstrap arrangement forcing it into regulation. However, if such a circuit is disrupted during its normal operation, and the supply voltage remains stable, the mirror may be forced into a permanent "off" condition.

In view of the above, it is clear that there exists a need to develop an improved reference generator for providing the extremely low current required by modern integrated circuit devices over what is presently known in the art. Such a reference generator would ideally supply a bias current with very little temperature dependence and would provide high rejection of transients on the input voltage. It would use very little overhead current, and it would provide means for ensuring that it could not be forced permanently out of regulation by system transients. It would preferably avoid the use of the traditional capacitive trigger as the start-up circuit, so that the power supply would not have to be ramped each time the bias is lost during operation. Finally, such a reference generator would preferably have an active-low logic implementation with switching near the TTL range and with a zero-current off state.

SUMMARY OF THE INVENTION

In accordance with the principles of the present invention, there is disclosed herein a bootstrapping current reference which comprises a first node adapted to be coupled to a supply voltage, a second node adapted to be coupled to a reference potential, a cascoded $\Delta V_{be}$ current reference, and a current mirror. The cascoded $\Delta V_{be}$ current reference and the current mirror are coupled in a cascode configuration between the first and second nodes.

In accordance with a preferred embodiment of the present invention, there is provided switching means responsive to a control signal for selectively enabling current flow from the bootstrapping current reference, the switching means being responsive to a relatively low voltage level of the control signal for enabling the current flow, and responsive to a relatively high voltage level of the control signal for disabling the current flow. Further in accordance with a preferred embodiment, the switching means includes means for inhibiting current flow between the first and second nodes while the control signal is disabling the current flow from the bootstrapping current reference. Still further in accordance with a preferred embodiment, the switching means includes hysteresis apparatus for increasing the relatively high voltage level for disabling the current flow when the switching means is enabling the current flow from the bootstrapping current reference.

Further in accordance with the present invention, there is disclosed a reference generator which comprises a bootstrapping current reference for providing a current at an output thereof, and means responsive to the absence of current at the output for generating a start-up current to the bootstrapping current reference.

Still further in accordance with the present invention, there is disclosed a bootstrapping current reference which comprises a first node adapted to be coupled to a supply voltage, a second node adapted to be coupled to a reference potential, and a cascoded $\Delta V_{be}$ current reference for providing a current at an output thereof. The bootstrapping current reference also comprises a current mirror coupled in a cascode configuration with the cascoded $\Delta V_{be}$ current reference between the first and second nodes, and means responsive to the absence of current at the output for generating a start-up current to the current mirror.

BRIEF DESCRIPTION OF THE DRAWING

The foregoing features of the present invention may be more fully understood from the following detailed description, read in conjunction with the accompanying drawing, wherein:

the sole FIGURE is a schematic diagram of a low current reference generator in accordance with the present invention.

DESCRIPTION OF THE PREFERRED EMBODIMENT

Figure 1A:
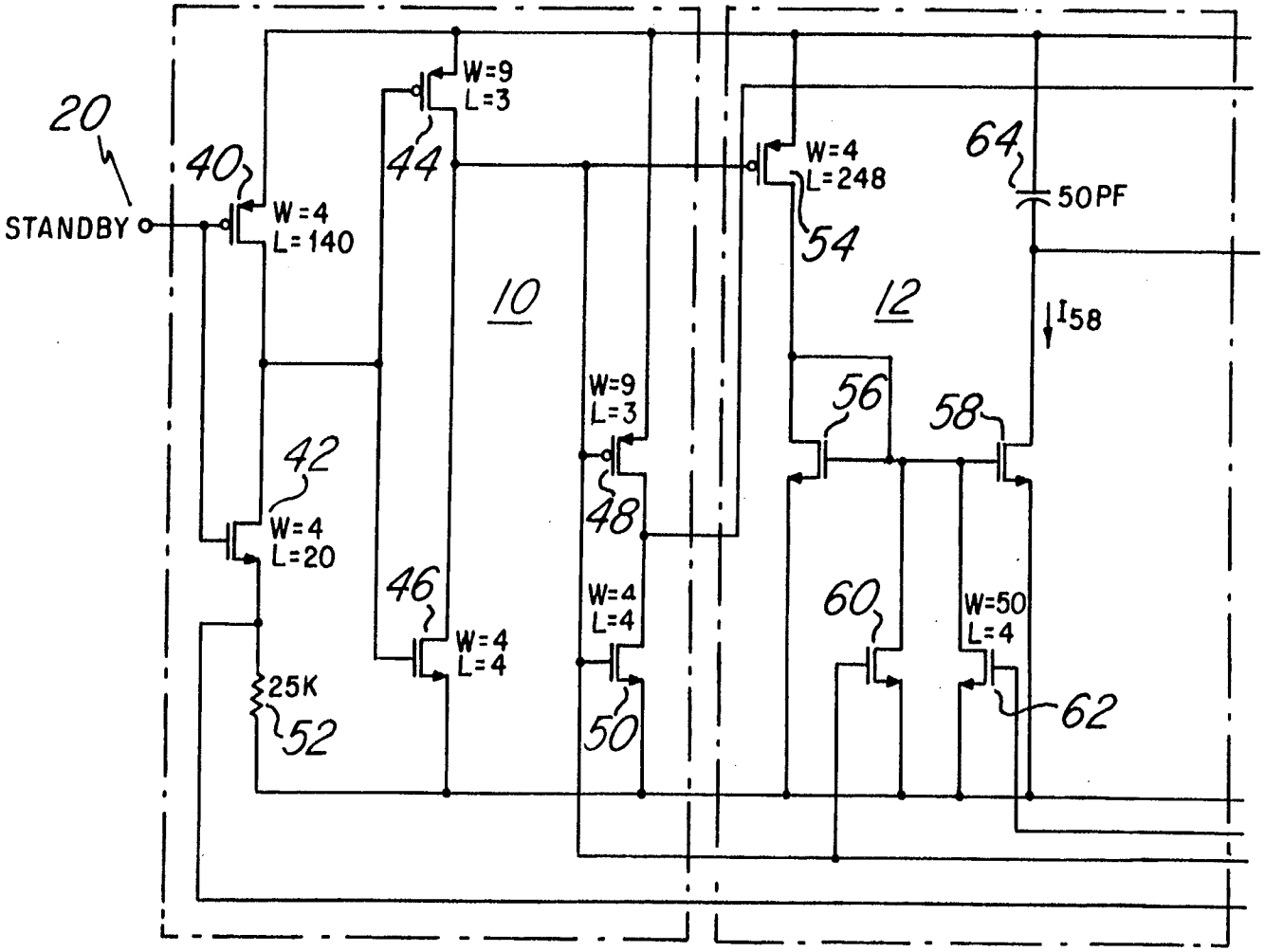
Figure 1B:
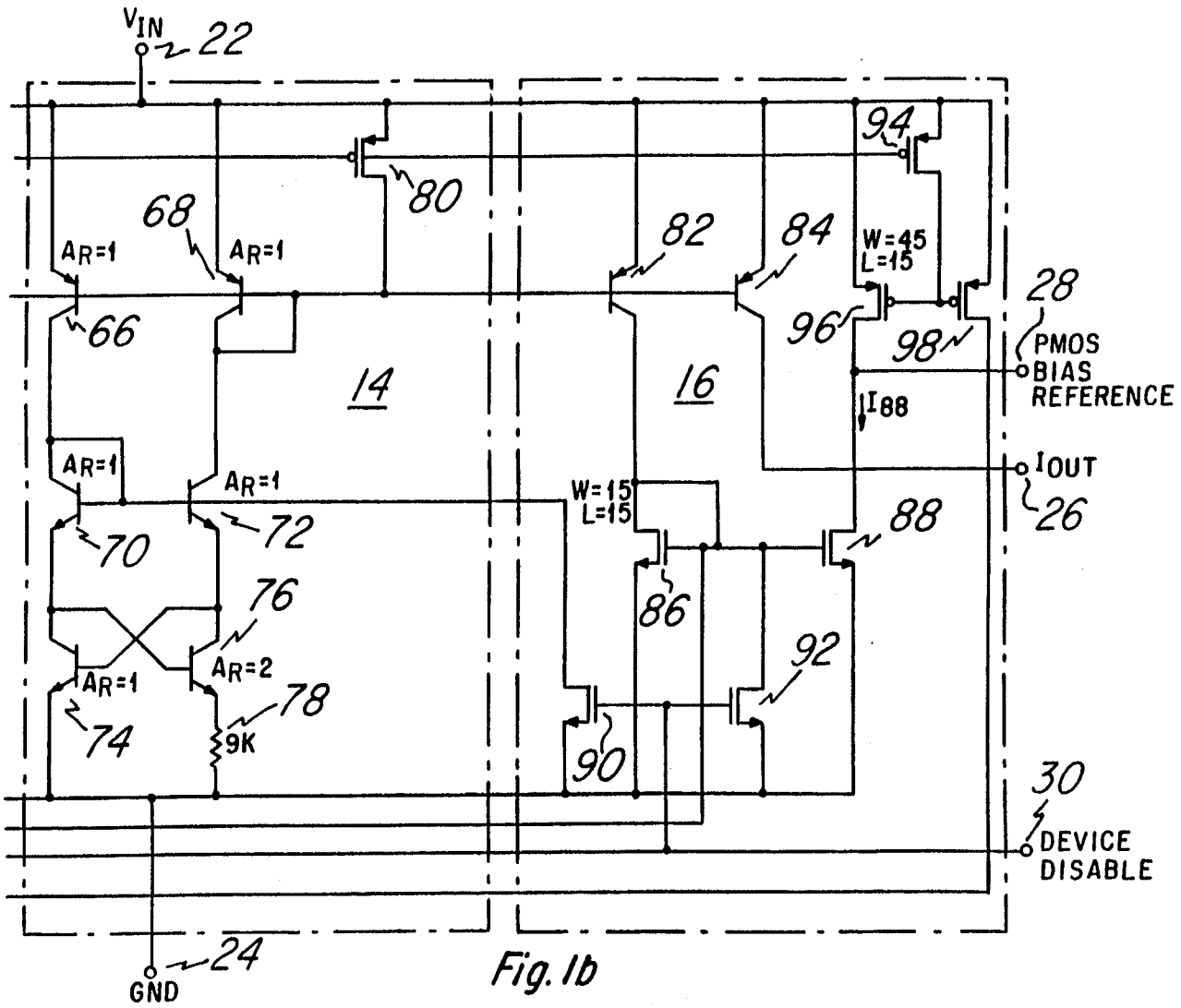

Referring to the FIGURE, there is shown a schematic diagram of an active-low, switchable, accurate low-current reference generator with zero off-state current, in accordance with the principles of the present invention. The reference generator includes standby logic 10 comprising field effect transistors (FET's) 40, 42, 44, 46, 48 and 50, and resistor 52. The reference generator also includes start-up circuitry 12 comprising FET's 54, 56, 58, 60 and 62, and capacitor 64. The reference generator additionally includes current generator circuitry 14 comprising transistors 66, 68, 70, 72, 74, 76, resistor 78 and FET 80. Finally, the reference generator includes bias supplies circuitry 16 comprising transistors 82 and 84, and FET's 86, 88, 90, 92, 94, 96 and 98.

In the embodiment illustrated herein, an integrated circuit including the above-mentioned elements is fabricated using bipolar as well as Metal-Oxide Semiconductor (MOS) devices. In this example, FET's 40, 44, 48, 54, 80, 94, 96 and 98 are p-channel (PMOS) devices; and FET's 42, 46, 50, 56, 58, 60, 62, 86, 88, 90 and 92 are n-channel (NMOS) devices. Bipolar transistors 66, 68, 82 and 84 are PNP devices; and bipolar transistors 70, 72, 74 and 76 are NPN devices.

A first input node 20, coupled to the gate electrodes of FET's 40 and 42, is adapted for receiving the input signal STANDBY for enabling the bias supplies of the disclosed circuit. In this implementation, STANDBY is an active-low signal employing typical TTL voltage levels. A first voltage supply node 22, denoted $V_{IN}$, is adapted for receiving a positive supply voltage, which may typically be between two and ten volts, and which may illustratively be five volts, and a second voltage supply node 24, denoted GND, is adapted for receiving a reference potential, illustratively ground. A first output node 26, denoted $I_{OUT}$, is adapted to provide a constant output current of 2 microamperes. A second output node 28, denoted PMOS BIAS REFERENCE, is adapted to supply an output current of 2 microamperes into a device having, in this example, a channel width-to-length ratio (W/L) of 45/15. Finally, output node 30, denoted DEVICE DISABLE, provides a high level output indicative of the "off" state of the present device, which may be used by adjoining circuitry (not shown) to power off its active devices.

Considering first the standby logic 10, CMOS FET series-connected pairs 40–42, 44–46 and 48–50 are all arranged as CMOS inverters, each pair being coupled between the positive supply voltage and the reference potential. Each pair comprises a PMOS device and an NMOS device, wherein the gate electrodes of the two devices are interconnected to form the inverter input, and wherein the drain electrode of the PMOS device is coupled to the drain electrode of the NMOS device to form the inverter output. The channel W/L ratios of FET's 40 and 42 are selected so as to establish the switching threshold of their inverter at the center of the TTL range. That is, the use of a 4/140 channel ratio for FET 40 and a 4/20 channel ratio for FET 42, in the present example, sets the inverter switching threshold at approximately 1.4 volts, which is midway between the highest TTL logic low level of 0.8 volts and the lowest TTL logic high level of 2.0 volts. The FET channel W/L ratios of the CMOS inverters comprising FET pairs 44–46 and 48–50 are sized such as to provide their switching thresholds at CMOS operating levels. In the present example, the channel W/L ratio of PMOS FET's 44 and 48 is 9/3, and the channel W/L ratio of NMOS FET's 46 and 50 is 4/4. The output of the CMOS inverter comprising FET's 44 and 46 generates the DEVICE DISABLE signal at output node 30.

Resistor 52, coupled between the source electrode of FET 42 and ground, in conjunction with PMOS FET 98, provides hysteresis so as to raise the trip threshold at input node 20 after the STANDBY signal has gone low. In this example, FET 98 supplies a 2 μA current to establish a hysteresis voltage of 50 mV across resistor 52, which has a resistance of 25 kΩ. The voltage established across resistor 52 increases the trip threshold of the STANDBY signal. by the same amount, thereby creating hysteresis in this signal. The hysteresis voltage drops out after the voltage level of the STANDBY signal increases to the point where it crosses the new (higher) trip threshold.

Considering next the start-up circuitry 12, NMOS FET's 56 and 58 are configured as a self-starting current mirror having their gate electrodes connected to the drain electrode of FET 56 and their source electrodes connected to the reference potential. Current is supplied to the drain electrode of FET 56 via the drain electrode of switching PMOS FET 54, whose source electrode is coupled to the positive supply voltage, and whose gate electrode is connected to the output of the inverter stage comprising FET's 44 and 46. The drain electrode of FET 58 is coupled to the (−) terminal of capacitor 64, and to the base electrodes of PNP transistors 66, 68, 82 and 84. The (+) terminal of capacitor 64 is coupled to the positive supply voltage.

A switching transistor, NMOS FET 60, is coupled between the gate electrodes of current mirror FET's 56 and 58 and the reference potential, having its gate electrode connected to the output of the inverter stage comprising FET's 44 and 46, so as to draw the voltage at the gate electrodes of FET's 56 and 58 down to the reference potential when the inverter output is high. NMOS FET 62, which forms a mirror with NMOS FET 86, has its drain electrode coupled to the gate electrodes of current mirror FET's 56 and 58 and its source electrode coupled to the reference potential. The gate electrode of FET 62 is connected to the gate and drain electrodes of its mirror FET 86. The channel W/L ratios of mirror FET's 86 and 62 are sized such as to provide substantial current gain in FET 62. In the present example, the channel W/L ratio of FET 86 is 15/15 and the channel W/L ratio of FET 62 is 50/4.

Considering now the current generator circuitry 14, PNP bipolar transistors 66, 68, 82 and 84 form a current mirror with all of their base electrodes connected to the collector electrode of transistor 68, and all of their emitter electrodes coupled to the positive supply potential. A switching transistor, PMOS FET 80, is coupled between the base electrodes of the mirrored transistors 66, 68, 82 and 84 and the positive supply potential, having its gate electrode connected to the output of the inverter stage comprising FET's 48 and 50, so as to draw the voltage at the base electrodes of the bipolar transistors up to the potential of their emitter electrodes when the inverter output is low. Transistor 68, the diode reference transistor which sets the PNP current mirrors, has its collector electrode coupled to the collector of NPN transistor 72, and transistor 66, the bootstrap transistor, has its collector electrode coupled to the collector of NPN transistor 70. The collector electrode of transistor 70 is connected to the base electrodes of transistors 70 and 72. Transistor 70 is coupled in cascode configuration with NPN transistor 74, wherein the emitter electrode of transistor 70 is coupled to the collector electrode of transistor 74. Transistor 72 is coupled in cascode configuration with NPN transistor 76, wherein the emitter electrode of transistor 72 is coupled to the collector electrode of transistor 76. The base electrode of transistor 74 is coupled to the collector electrode of transistor 76, and the base electrode of transistor 76 is coupled to the collector electrode of transistor 74. The emitter electrode of transistor 74 is coupled to the reference potential, and the emitter electrode of transistor 76 is coupled through resistor 78 to the reference potential. In the present example, the resistance of resistor 78 is 9 kΩ.

This configuration forms a cross-coupled, cascoded $\Delta V_{be}$ current reference. The current at the output of this reference, the collector electrode of transistor 72, is mostly independent of the current at its input, the collector electrode of transistor 70, and has an extremely high output impedance, giving it a large degree of power supply rejection.

Finally, considering the bias supplies circuitry 16, the mirrored PNP bipolar transistors 82 and 84 have their emitter electrodes coupled to the positive supply voltage. The collector electrode of transistor 82, which functions as a current supply to generate the PMOS BIAS REFERENCE signal, is coupled to the drain electrode of NMOS FET 86. The collector electrode of transistor 84, which generates the output current $I_{OUT}$, is coupled to output node 26.

NMOS FET's 86 and 88 (together with NMOS FET 62 mentioned earlier) comprise a current mirror, wherein the gate electrodes of FET's 86 and 88 (and 62) are coupled to the collector electrode of PNP transistor 82, and the source electrodes of both FET's 86 and 88 (and 62) are coupled to the reference potential. A first switching transistor, NMOS FET 92, is coupled between the gate electrodes of current mirror FET's 86 and 88 and the reference potential, having its gate electrode connected to the output of the inverter stage comprising FET's 44 and 46, so as to draw the voltage at the gate electrodes of FET's 86 and 88 down to the reference potential when the inverter output is high. Similarly, a second switching transistor, NMOS FET 90, is coupled between the base electrodes of NPN transistors 70 and 72 and the reference potential, also having its gate electrode connected to the output of the inverter stage comprising FET's 44 and 46, so as to draw the voltage at the base electrodes of NPN transistors 70 and 72 down to the reference potential when the inverter output is high.

PMOS FET's 96 and 98 comprise a current mirror, having their gate electrodes coupled to the drain electrode of FET 96 and to the drain electrode of NMOS FET 88, and having their source electrodes coupled to the positive voltage supply. A switching transistor, PMOS FET 94, is coupled between the gate electrodes of current mirror FET's 96 and 98 and the positive voltage supply, having its gate electrode connected to the output of the inverter stage comprising FET's 48 and 50, so as to draw the voltage at the gate electrodes of FET's 96 and 98 up to the voltage of their source electrodes when the inverter output is low.

Considering now the operational aspects of a reference generator in accordance with the present invention, with the STANDBY signal at its high (inactive) level, i.e., above the lowest "high" level for TTL logic, NMOS FET 42 will overdrive PMOS FET 40 and pull their interconnected drain electrodes to a low CMOS level. This low level is inverted to a high CMOS level by the first inverter comprising FET's 44 and 46, which, in turn, is inverted to a low CMOS level by the second inverter comprising FET's 48 and 50. In this quiescent state, these CMOS inverters cause the following to happen: (a) switching PMOS FET 80 is turned on, thereby effectively holding the $V_{be}$ of PNP transistors 66, 68, 82 and 84 at zero volts; (b) switching PMOS FET 94 is turned on, thereby effectively holding the $V_{gs}$ of current-mirrored PMOS FET's 96 and 98 at zero volts; (c) switching NMOS FET 92 is turned on, thereby effectively holding the $V_{gs}$ of current-mirrored PMOS FET's 86, 88 and 62 at zero volts; (d) switching NMOS FET 90 is turned on, thereby effectively holding the base electrodes of NPN transistors 70 and 72 at the reference potential, and ensuring also that NPN transistors 74 and 76 are non-conducting; (e) switching NMOS FET 60 is turned on, thereby effectively holding the $V_{gs}$ of current-mirrored PMOS FET's 56 and 58 at zero volts; and (f) PMOS FET 54 is held in its off state. It will be recognized that the particular conductive states of switching FET's 80, 94, 92, 90 and 60 ensure that no linear devices of the reference generator of the present invention draw any supply current (apart from negligible leakage currents) while the STANDBY signal is at its high level.

The reference generator of the present invention is activated when the STANDBY signal drops to a low TTL level, causing changes in the logic states of the three inverters comprising FET's 40 and 42, FET's 44 and 46, and FET's 48 and 50. In this activated state, these CMOS inverters cause the following to happen: (a) switching PMOS FET 80 is turned off, appearing as an open circuit across the base and emitter electrodes of PNP transistors 66, 68, 82 and 84; (b) switching PMOS FET 94 is turned off, appearing as on open circuit across the gate and source electrodes of current-mirrored PMOS FET's 96; (c) switching NMOS FET 92 is turned off, appearing as on open circuit across the gate and source electrodes of current-mirrored PMOS FET's 86, 88 and 62; (d) switching NMOS FET 90 is turned off, appearing as an open circuit at the base electrodes of NPN transistors 70 and 72; (e) switching NMOS FET 60 is turned off, appearing as on open circuit across the gate and source electrodes of current-mirrored PMOS FET's 56 and 58; and (f) PMOS FET 54 is switched to its conducting state.

FET 54, which, in the present example, has a channel W/L ratio of 4/248, conducts a small amount of current into FET 56; this current flow is mirrored by FET 58 and, with FET 62 in an open condition, a start-up current denoted $I_{58}$, begins to flow through FET 58. Thus, FET 58 begins to supply base current in an open loop mode to the PNP transistors 66, 68, 82 and 84, which, in turn, begin to conduct, initiating a bootstrapping process.

Bootstrapping is a technique by which a reference circuit uses an active load whose current is controlled by the output of the current reference. All reference circuits require bias currents with which to regulate their outputs. An active load allows this bias current to be largely independent of the power supplies for the circuits. However, an active load requires a reference to initiate current flow. When constructing an independent reference, there is no previous reference to drive the active load. Therefore, bootstrapping allows the active load to be driven from the generated current itself. While this solves the problem of providing an initial reference, it adds the requirement of having to initiate current flow. In a bootstrapping circuit, the circuit pulls itself into regulation.

In this example, transistors 70, 72, 74, 76 and resistor 78 form the current reference. Transistor 68 provides a diode reference to allow mirroring of the output current of the current reference. Transistor 66 serves as an active load and, further, as a bootstrapping active load, due to its base electrode being coupled to the base electrode of diode reference transistor 68.

Transistors 66 and 68 begin supplying collector current which ensures that current will flow through all of the NPN transistors 70, 72, 74 and 76. In this configuration, the cascode of transistors 72 and 76 function as the output stage, and the current mirror formed by transistors 66 and 68 function as an active matched load. This arrangement increases the output impedance of the reference generator to thereby provide better input supply rejection. Transistors 66, 68, 70, 72, 74 and 76, and resistor 78 comprise the bootstrapping current generator.

As NPN transistors 70, 72, 74 and 76 begin to conduct, the bootstrapping process takes effect. Since the relative areas ($A_R$) of transistors 66 and 68 are equal, and the relative areas of transistors 70 and 72 are equal, and assuming negligible base current in transistors 66, 68, 70, 72, 74 and 76, i.e., the transistor gains are high, the current through transistor 68 must be equal to the current through transistor 72. Because of the current mirroring arrangement including transistors 66 and 68, the current through transistor 66 must equal the current through transistor 68 which, in turn, threes an equal current through transistor 70. Thus, the bootstrapping process will continue until a steady-state condition is reached. In this case, such a steady-state condition is achieved when the following equation is satisfied for the current flowing through the leg comprising transistors 68, 72 and 76 and resistor 78:

Current=(k.T/q).ln (area of 76/area of 72)/Resistor 78 where k=the Boltzmann constant=$1.38\times10^{-23}$ Joules/° K

T=temperature in ° K.

q=charge on an electron=$1.6\times10^{-19}$ coulombs and k.T/q=$V_T$ (thermal voltage)=25.86 mV at room temperature.

In the present example, where the relative area of transistor 72 is $A_R=1$ and the relative area of transistor 76 is $A_R=2$, and where the resistance of resistor 78 is 9 kΩ, the steady-state current flow through transistor 68 is 2 μA. In a preferred embodiment, resistor 78 is made from a material with a temperature coefficient that will minimize the effect of temperature on the final current. By virtue of the current mirroring arrangement involving PNP transistors 66, 68, 82 and 84, this steady-state flow of 2 μA is provided through each of these transistors. Thus, transistor 84, coupled to output node 26, provides an output bias current, $I_{OUT}$, of 2 μA, and transistor 82, coupled through current-mirrored FET's 86 and 88 to output node 28, provides a bias voltage level at output node 28, denoted PMOS BIAS REFERENCE, which establishes, for a given W/L ratio of an external P-channel device (equal to the W/L ratio of FET 96), a $V_{gs}$ that will supply a current equal to $I_{88}$ which, in the present example, is 2 μA.

Once the bootstrapping process has begun, the reference generator of the present invention includes the means for dropping out $I_{58}$, so that the base electrode drive to the PNP transistors will be maintained via the tieback between the base and collector electrodes of diode reference transistor 68. Because of its current mirroring with diode reference transistor 68, PNP transistor 82 conducts current into the drain electrode of FET 86, thereby raising the potential at the gate electrodes of FET's 86, 88 and 62. In the present example, the channel W/L ratios of FET's 86 and 62 are (15/15) and (50/4), respectively, and hence the mirror of these devices provides a substantial gain through FET 62 which collapses the $V_{gs}$ of current-mirrored FET's 56 and 58, thereby disabling the flow of start-up current $I_{58}$.

The reference generator thus described is deemed to be uninterruptible. It will be observed that any circumstance which causes the interruption of current through the PNP transistors 66, 68, 82 and 84, drops the voltage at the gate electrode of FET 62, enabling start-up current to flow through FET 58, and thereby re-initiating the bootstrapping process. In addition, capacitor 64 also serves to protect against interruption of the current flow through PNP transistors 66, 68, 82 and 84 by maintaining a fixed reference voltage between their base and emitter electrodes.

The reference generator of the present invention, as illustrated in the FIGURE and as described above, provides several advantages over prior art approaches and surmounts certain limitations thereof. The disclosed reference generator provides a bias current with a very low temperature coefficient and very little supply dependence. It has an active-low logic implementation with switching near the TTL range and with a zero-current off state. It uses very little overhead current, and it cannot be forced permanently out of regulation by system transients. The start-up scheme uses actual detection of the absence of a bias current as its trigger. This means that should the bias be lost during operation, the reference generator will restart without the need for a power supply ramping. Hence, for the type of reference generator envisioned herein, the approach in accordance with the present invention provides significant advantages.

While the principles of the present invention have been demonstrated with particular regard to the structure disclosed herein, it will be recognized that various departures may be undertaken in the practice of the invention. As an example, whereas the bootstrapping circuit disclosed in the illustrative embodiment is shown in a current reference, it will be recognized by those of skill in the art to which it pertains that a bootstrapping apparatus and technique can be used in other types of circuitry, such as in a band-gap voltage reference. The scope of the invention is therefore not intended to be limited to the particular structure disclosed herein, but should instead be gauged by the breadth of the claims which follow.

What is claimed is:

1. A bootstrapping current reference comprising:

a first node adapted to be coupled to a supply voltage;

a second node adapted to be coupled to a reference potential;

a cross-coupled, cascoded $\Delta V_{be}$ current reference having an input node and an output node; and a current mirror having an input node and an output node, said cascode $\Delta V_{be}$ current reference and said current mirror coupled in a cascode configuration between said first and second nodes, wherein the input node of said cascoded $\Delta V_{be}$ current reference is coupled to the output node of said current mirror and the output node of said cascoded $\Delta V_{be}$ current reference is coupled to the input node of said current mirror.

2. The bootstrapping current reference in accordance with claim 1 further including switching means responsive to a control signal for selectively enabling current flow from said bootstrapping current reference.

3. The bootstrapping current reference in accordance with claim 2 wherein said switching means is responsive to a relatively low voltage level of said control signal for enabling said current flow, and is responsive to a relatively high voltage level of said control signal for disabling said current flow.

4. The bootstrapping current reference in accordance with claim 3 wherein said switching means includes means for inhibiting current flow between said first and second nodes while said control signal is disabling said current flow from said bootstrapping current reference.

5. The bootstrapping current reference in accordance with claim 3 wherein said switching means includes hysteresis apparatus for increasing said relatively high voltage level for disabling said current flow when said switching means is enabling said current flow.

6. A low bias current, uninterruptible reference generator comprising:

an output node for receiving an output current generated by said reference generator;

a bootstrapping current reference for providing a reference current;

means responsive to said reference current for generating said output current; and a start-up circuit for providing a start-up current to said bootstrapping current reference in response to an absence of current at said output node, said start-up circuit comprising only active devices.

7. The reference generator in accordance with claim 6 wherein said start-up circuit includes means for inhibiting said start-up current in response to current flow at said output node.

8. The reference generator in accordance with claim 6 wherein said bootstrapping current reference includes a cascoded $\Delta V_{be}$ current reference.

9. The reference generator in accordance with claim 6 wherein said bootstrapping current reference includes a cross-coupled, cascoded $\Delta V_{be}$ current reference.

10. The reference generator in accordance with claim 6 wherein said bootstrapping current reference includes a current mirror, said current mirror being responsive to said start-up current.

11. The reference generator in accordance with claim 6 further including switching means responsive to a control signal for selectively enabling current flow from said bootstrapping current reference.

12. The reference generator in accordance with claim 11 wherein said switching means is responsive to a relatively low voltage level of said control signal for enabling said current flow, and is responsive to a relatively high voltage level of said control signal for disabling said current flow.

13. The reference generator in accordance with claim 12 wherein said switching means further includes:

a first node adapted to be coupled to a supply voltage;

a second node adapted to be coupled to a reference potential; and means for inhibiting current flow between said first and second nodes while said control signal is disabling said current flow.

14. The reference generator in accordance with claim 12 wherein said switching means includes hysteresis apparatus for increasing said relatively high voltage level for disabling said current flow when said switching means is enabling said current flow.

15. A bootstrapping current reference comprising:

a first node adapted to be coupled to a supply voltage;

a second node adapted to be coupled to a reference potential;

a cross-coupled, cascoded $\Delta V_{be}$ current reference for providing a current at an output thereof;

a current mirror coupled in a cascode configuration with said cascoded $\Delta V_{be}$ current reference between said first and second nodes; and a start-up circuit for providing a start-up current to said current mirror in response to an absence of current at said output node, said start-up circuit comprising only active devices.

16. The bootstrapping current reference in accordance with claim 15 wherein said start-up circuit includes means for inhibiting said start-up current in response to current flow at said output node.

17. The bootstrapping current reference in accordance with claim 15 further including switching means responsive to a control signal for selectively enabling current flow at said output.

18. The bootstrapping current reference in accordance with claim 17 wherein said switching means is responsive to a relatively low voltage level of said control signal for enabling current flow at said output, and is responsive to a relatively high voltage level of said control signal for disabling current flow at said output.

19. The bootstrapping current reference in accordance with claim 18 wherein said switching means includes means for inhibiting current flow between said first and second nodes while said control signal is disabling current flow at said output.

20. The bootstrapping current reference in accordance with claim 18 wherein said switching means includes hysteresis apparatus for increasing said relatively high voltage level for disabling current flow at said output when said switching means is enabling current flow at said output.

* * * * *